US009745186B2

(12) United States Patent
Hecht

(10) Patent No.: US 9,745,186 B2
(45) Date of Patent: Aug. 29, 2017

(54) DISPENSE POINT ISOLATION DEVICE

(71) Applicant: Automatic Bar Controls, Inc., Vacaville, CA (US)

(72) Inventor: Thomas R. Hecht, Winters, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 81 days.

(21) Appl. No.: 14/253,736

(22) Filed: Apr. 15, 2014

(65) Prior Publication Data

US 2014/0305967 A1 Oct. 16, 2014

Related U.S. Application Data

(66) Substitute for application No. 61/812,670, filed on Apr. 16, 2013.

(51) Int. Cl.
*B67D 1/00* (2006.01)

(52) U.S. Cl.
CPC ..... *B67D 1/0052* (2013.01); *B67D 1/0021* (2013.01); *B67D 1/0044* (2013.01); *B67D 1/0049* (2013.01); *B67D 1/0084* (2013.01)

(58) Field of Classification Search
CPC .... B67D 1/0021; B67D 1/0044; B67D 1/005; B67D 1/0015; B67D 1/004; B67D 1/0048; B67D 1/0049; B67D 1/0081–1/0084

(Continued)

(56) References Cited

U.S. PATENT DOCUMENTS 1,261,986 A * 4/1918 White ..... B67D 1/0021 134/199
3,349,968 A * 10/1967 Yuza ..... B67D 1/0044 222/132

(Continued)

FOREIGN PATENT DOCUMENTS

WO 90/08728 A1 8/1990
WO 2007/056407 A2 5/2007

OTHER PUBLICATIONS

International Search Report and Written Opinion mailed Aug. 18, 2014, from PCT Application No. PCT/US2014/034170 (11 pages).

*Primary Examiner* — Paul R Durand
*Assistant Examiner* — Andrew P Bainbridge
(74) *Attorney, Agent, or Firm* — Kilpatrick Townsend & Stockton LLP

(57) ABSTRACT

Devices for dispensing beverages, particularly multiple differing beverages from a dispensing nozzle, are provided herein. In an exemplary embodiment, a multiple beverage dispensing device includes a dispensing array attached to a dispense point isolation device within a dispensing nozzle, the dispensing array facilitates flow of a beverage base and at least one beverage additive into the dispensing nozzle and the dispense point isolation device isolating discharge of beverage additive to prevent cross-contamination and color-carryover caused by the residual traces of beverage additive often associated with conventional dispensing devices. In many embodiments, the dispense point isolation device further includes one or more isolation features, including any or all of a recess, trough, notch, raised ridge or tubular projection around an exit orifice of the beverage additive flow channel so as to further isolate release of the beverage additive and further inhibit cross-contamination and color-carryover.

31 Claims, 6 Drawing Sheets

SECTION F-F

(58) Field of Classification Search
USPC ..... 222/129.1, 132, 135, 145.2, 330, 222/460–462, 478–489, 566–571
See application file for complete search history.

(56) References Cited

U.S. PATENT DOCUMENTS

| | | | | | |
|---|---|---|---|---|---|
| 3,830,405 | A * | 8/1974 | Jaeger | B67D 1/0021 | 222/129.3 |
| 4,708,266 | A * | 11/1987 | Rudick | B67D 1/0036 | 222/105 |
| 5,203,474 | A * | 4/1993 | Haynes | B67D 1/005 | 222/129.1 |
| 6,173,862 | B1 * | 1/2001 | Buca | B67D 1/0043 | 222/1 |
| 7,445,133 | B2 * | 11/2008 | Ludovissie et al. | | 222/145.5 |
| 2007/0205219 | A1 * | 9/2007 | Ziesel et al. | | 222/129.1 |
| 2009/0230149 | A1 * | 9/2009 | Smeller et al. | | 222/145.5 |
| 2012/0055954 | A1 * | 3/2012 | Hecht | | 222/129.1 |

* cited by examiner

SECTION C-C

SECTION D-D

DISPENSE POINT ISOLATION DEVICE

CROSS REFERENCE TO RELATED APPLICATIONS

This application claims the benefit of U.S. Provisional Application No. 61/812,670, filed Apr. 16, 2013, entitled "Dispense Point Isolation Device," the disclosure of which is incorporated by reference herein in its entirety.

BACKGROUND OF THE INVENTION

1. Field of Invention

The present invention relates to a nozzle device for use in a beverage dispensing system, and in particular, a dispensing array for use in a multiple flavor beverage dispensing system utilizing multiple differing beverage additives.

2. Description of the Related Art

Conventional beverage dispensing systems are commonly used in a wide variety of locales, including restaurants, snack bars, convenience stores, movie theaters, and any business where beverages are served. These beverage dispensing systems often dispense a variety of beverages of differing types and flavors, such as flavored carbonated sodas, iced tea, water, or even alcoholic beverages. Typically, such devices use a post mix dispenser that mixes a beverage additive (e.g., a flavored syrup) with a base beverage fluid (e.g., water or soda) before discharging through a discharge nozzle into a beverage container. Many such beverage dispensing systems, often referred to as a beverage tower, utilize a dedicated nozzle for each flavor or beverage. Since each nozzle typically require a minimum clearance around the discharge nozzle for placement of a beverage container under the nozzle, these configuration can result in relatively large devices. Often, the more beverages a device is configured to provide, the wider the device becomes. This can be problematic since often these devices are set-up in places of business to allow self-service by customers and larger devices are generally undesirable as they occupy valuable floor space.

To address this problem, multiple beverage dispensing devices that dispense beverages of differing types and flavors from a single discharge nozzle have been developed. Although conventional devices that use a single discharge nozzle to dispense multiple differing beverages can significantly reduce the amount of floor space dedicated to beverage dispensing, these devices present their own drawbacks.

One commonly encountered problem when dispensing differing beverages through a single discharge nozzle is cross-contamination and/or color carry-over between beverages. In cross-contamination, residual beverage additive from dispensing a first beverage left on one or more components within the discharge nozzle may contaminate a subsequently dispensed beverage. For example, residual lemon flavored additive may inadvertently mix with subsequently discharged water causing a noticeable, unpleasant taste or smell, or residual sugars from a "sugared" drink, such as a regular cola, could mix with a non-sugared drink, such as a diet beverage. In color carry-over, a residual coloring additive from one beverage may "carry over" or contaminate a subsequently discharged beverage leading to a discolored beverage. For example, when dispensing a beverage having darker coloring additives, such as a cola beverage, a residual amount of the cola colorant may contaminate and discolor a subsequently dispensed clear beverage, such as water or a lemon-lime soda, or a clear beverage may be contaminated with a red-colored beverage additive resulting in an undesirable red or pink colored beverage.

Another drawback is that the mixing of the beverage additive and beverage base within the nozzle may result in undesirable splashing or travel of residual beverage additive, particularly in a device that dispenses differing beverages from a single discharge nozzle. In attempting to avoid leaving residual beverage additive within the nozzle, multiple beverage dispensing devices may reduce mixing of the components within the nozzle, which may result in adequate mixing of the beverage additive and beverage base. The beverage additive and base beverage must be adequately mixed to ensure consistency and quality of the discharged beverage.

One problem associated with multiple beverage dispensing devices is that the viscosity of the beverage additive may contribute to the above noted contamination and cross-over problem. Dispensing of particularly viscous beverage additives, such as flavored syrups, may result in delayed dripping from the channel opening or transfer of residual droplets onto adjacent additive discharge orifices due to surface tension of the viscous beverage additive. Given the close proximity of the fluid channel openings, residual droplets of beverage additives can easily "travel" to an adjacent fluid channel opening, thereby resulting in contamination or color carry-over of a subsequently discharged beverage.

The nature of the above drawbacks can be described more fully by referencing a conventional device, commonly used in standard beverage dispensing applications, shown in FIG. 1. The multiple beverage dispensing device shown in FIG. 1 includes a dispensing array 1 (also commonly referred to as a diffuser) and dispensing nozzle 6, the dispensing array 1 has multiple channels through which a beverage base and a beverage additive flow are discharged into the dispensing nozzle 6 for mixing and dispensing as a beverage. During use of the diffuser shown in FIG. 1, a beverage base, such as water or the soda component of a beverage, enters the center top inlet 2 of the diffuser before being diverted radially outward along multiple flow paths 3 before being discharged into the dispensing nozzle 6. The beverage additives enter the diffuser through a beverage additive inlet 4 arranged more outwardly about the top of the dispensing array 1, and at a point of depth, divert the flow of additive inward along path 5 at such a distance and angle that the beverage additive remains separate from the beverage base paths 3 until both fluids exit the array and are subsequently mixed and contained by the beverage dispenser nozzle 6 which directs the combined flow stream into a suitable beverage container.

As can be seen in the diffuser of FIG. 1, the beverage additive paths 5 exit the dispensing array on a surface 7 of a conical cavity (or a concave face in some conventional devices). This angled face promotes the at rest beverage additive paths to "flow" at a very slow rate downward, collecting about the outermost bottom face 8 of the dispensing array 1, often falling off onto the inside surface 9 of the dispensing nozzle 6 where these undesired contaminants can be incorporated into subsequent beverages. Another problem associated with this configuration is that since the beverage additive pathways are brought inward toward their adjacent counterparts, this proximity can result in co-mingling of beverage additives thereby allowing a second means of beverage contamination.

Accordingly, it is desirable to develop methods and systems that overcome the aforementioned deficiencies of conventional beverage dispensing devices. Embodiments of the invention, individually and/or collectively, provide for improved devices that address these and other problems associated with dispensing of multiple beverages.

BRIEF SUMMARY OF THE INVENTION

Embodiments described herein provide improved devices for dispensing multiple differing beverages from a dispensing nozzle. In many embodiments, the device includes a beverage dispensing nozzle having a dispensing array with an attached dispense point isolation device for isolating discharge of beverage additive to prevent the problems of cross-contamination and color-carryover, as well as improve mixing and dispensing of the beverage.

In an exemplary embodiment, the beverage dispensing device comprises a dispensing nozzle for separately dispensing a plurality of differing beverages, each beverage comprising a beverage base and at least one beverage additive; a dispensing array having a top surface, an underside surface and a plurality of fluid flow paths and channels to facilitate downward flow of one or more beverage bases and one or more beverage additives, respectively, and a dispense point isolation device that diverts a flow of the beverage additive in a substantially vertical direction at the point of discharge into the dispensing nozzle. In many embodiments, the dispense point isolation device further includes additional isolation features for isolating the discharge of beverage additives from the device, these features including any or all of a recess, a trough, a notch, a raised ridge, or a tubular projection substantially surrounding an exit orifice through which one or more beverage additives are discharged so as to further isolate the flow of additives and prevent residual additives on the device and/or transfer of residual droplets of beverage additive onto an adjacent orifice.

In an exemplary embodiment, the dispense point isolation device has a plurality of additive outlet paths extending from an upper surface to an exit orifice in a bottom surface of the dispense isolation device, the upper surface of the device being coupled to the underside of the dispensing array so as to fluidly couple each of the plurality of outlet paths with a corresponding channel of the dispensing array, wherein during operation of the dispensing device, the outlet portion extends a distance substantially vertical adjacent the exit orifice so as to direct a flow of an additive from an exit orifice in a substantially vertical direction for mixing with the beverage base within the dispensing nozzle. Typically, the exit orifices extend along a substantially horizontal plane so as to promote uniform discharge of the additive through the exit orifice.

In one aspect, the each of the dispensing array and the dispense point isolation device are substantially circular and concentric about a central longitudinal axis extending through the device. Generally, the plurality of exit orifices in the bottom surface are arranged in a radial array about the central longitudinal axis, while the inlet portions of the plurality of channels are arranged in a radial array about the central axis along the top surface, the radius of the array of inlet portions being larger than the radius of the radial array of exit orifices. In many embodiments, each of the channels includes an angled portion extending a distance inward toward the central longitudinal axis along the downward flow path.

In many embodiments, the diameter of the outlet path is less than the diameter of at least the portion of the channel upstream of the outlet path. Generally, the dispensing array includes a central inlet for receiving the flow of beverage base and directing the flow into multiple fluid flow paths that diffuse the beverage base around the device for discharge into the nozzle. Typically, the diameter of each of the multiple fluid flow paths is less than the diameter of the central inlet, and often the cross-sectional areas of the multiple fluid flow paths, in combination, is less than the cross-sectional area of the central inlet so as to maintain carbonation of carbonated beverage bases diffused and discharged using the device.

In another aspect, the wherein the dispense point isolation device comprises a substantially flat bottom surface extending along a substantially horizontal plane, wherein the plurality of channels terminate in the exit orifices within the bottom surface. Typically, the exit orifices are circular so as to facilitate uniform release of the beverage additive from the orifice.

In another aspect, the dispensing array and/or the dispense point isolation device include an alignment and/or attachment features engageable with a corresponding alignment and/or attachment feature of at least one of the dispensing array, the dispense point isolation device and the housing of the beverage dispensing device so as to facilitate alignment or attachment of the components relative to each other as necessary for operation of the beverage dispensing device. In many embodiments, corresponding features include a locking pin that corresponds to a hole configured to receive the locking pin, however, the components may utilize any means suitable for alignment and/or attachment of the components.

Further understanding of the nature and the advantages of the embodiments disclosed and suggested herein may be realized by reference to the remaining portions of the specification and the attached drawings.

BRIEF DESCRIPTION OF THE DRAWINGS

In order to more fully understand the present embodiments of the invention, reference is made to the accompanying drawings, although these drawings are not to be considered limitations in the scope of the invention. The presently described embodiments and the presently understood best mode of the invention are described with additional detail through use of the accompanying drawings.

DETAILED DESCRIPTION OF THE INVENTION

Figure 1:
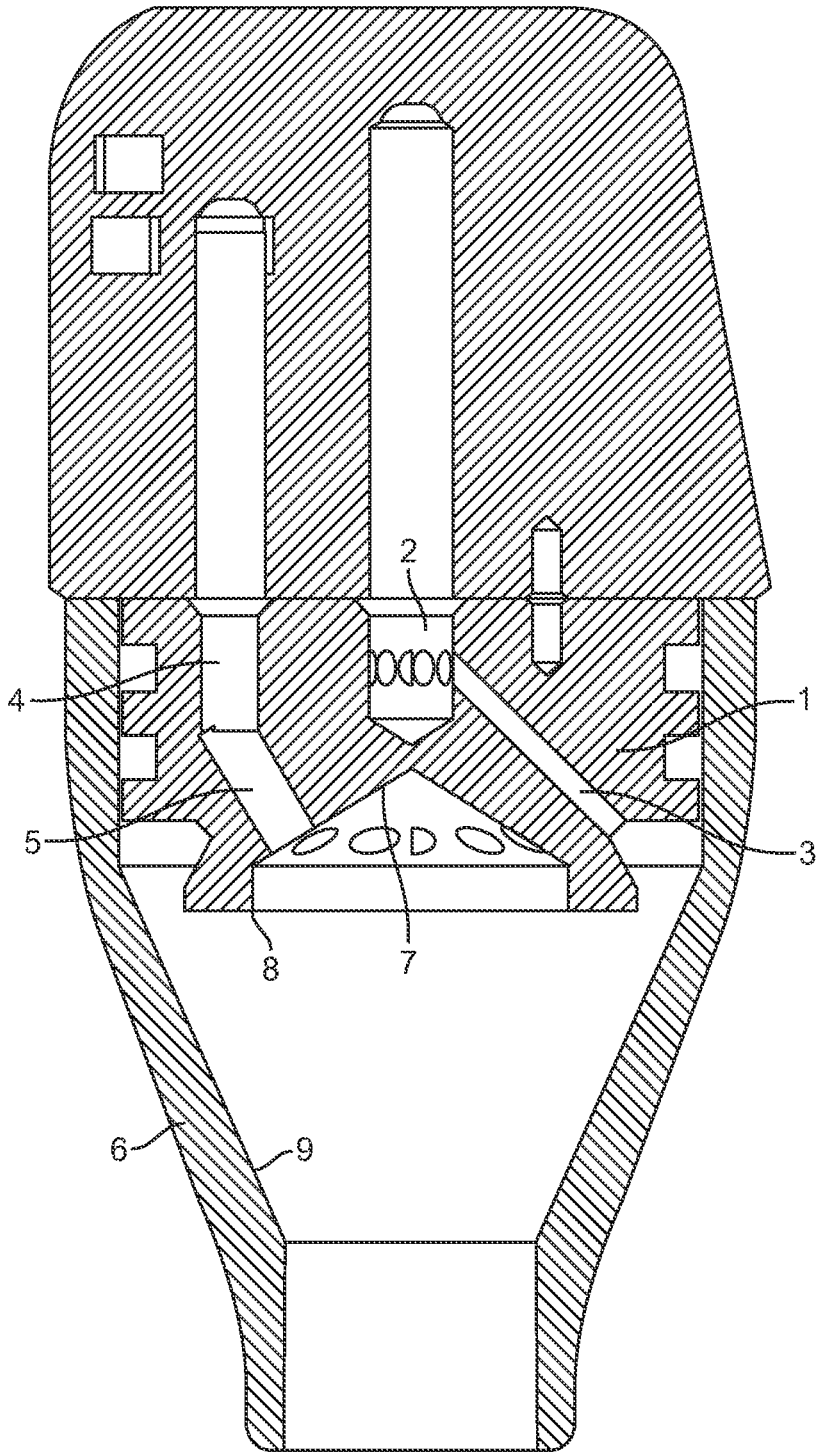
FIG. 1 (PRIOR ART)
FIG. 1 illustrates a vertical cross-sectional view of a conventional diffuser assembly used in a multiple beverage dispensing system according to the prior art.

Embodiments of the invention are generally directed to a beverage dispensing system, and more specifically to beverage dispenser that dispenses multiple differing beverages from a dispenser nozzle. Typically, the beverage dispensing system dispenses multiple differing beverages from a single dispensing nozzle. In an exemplary embodiment, the beverage dispensing system includes a dispensing array, also referred to as a diffuser, through which a base beverage and/or a beverage additive flow, an attached dispense point isolation device that facilitates separate discharge of beverage additives as desired for a particular beverage, and a dispensing nozzle in which the beverage additive and beverage base are mixed into the desired beverage, the desired beverage often being selected by a user. The dispense point isolation device is configured to "isolate" a beverage additive at the point of discharge into the dispense nozzle so as to inhibit cross-contamination and color-carryover between differing beverage additives used in subsequent beverages.

In an exemplary embodiment, the dispense point isolation device includes multiple outlet portions that direct a flow of the beverage additive along a substantially vertical direction. This is advantageous in that diverting the flow in a vertical direction provides more uniform discharge of the beverage additive from an exterior orifice, which reduces if not eliminates the amount of residual beverage additive that remains on the bottoms surface of the device. Typically, the bottom surface of the dispense point isolation device is substantially flat extending along a horizontal plane, any residual beverage additives is less prone to travel to an adjacent orifice, which would result in contamination of a beverage dispensed using the adjacent orifice. Additionally, an embodiment having a substantially flat bottom surface allows for a more circular exit orifice that facilitates more uniform discharge of the beverage additive, particularly when discharging viscous additives, when compared to a more elliptical orifice in an angled surface, such as in many conventional devices. In many embodiments, the dispense point isolation device further includes additional isolation features surrounding one or more exit orifices. Such devices includes any or all a recess, notch, a wall or tubular protrusion surrounding the exit orifice so that any residual beverage additive will be collected within the feature and/or prevented from travelling along the bottom surface away from its respective exit orifice.

In many embodiments, the device includes additional features and/or removable components. For example, a diffuser ring, such as an enhancing juice diffuser ring, may be attached to the device so as to divert flow of beverage base therethrough. Such diffuser rings may be incorporated into the device or may be of a non-removable design. In some embodiments, the device may include alignment and/or attachment features that may be used for proper assembly and attachment of various individual components of the device. Such features may include locating pins may be used for proper assembly and attachment of various individual components of the diffuser assembly.

The above aspects and improvements can be further understood with reference to the exemplary devices shown in FIGS. 2-12, although the invention is not limited to the depicted embodiments and may include many variations in accordance with the principles and aspects described herein.

Figure 4:
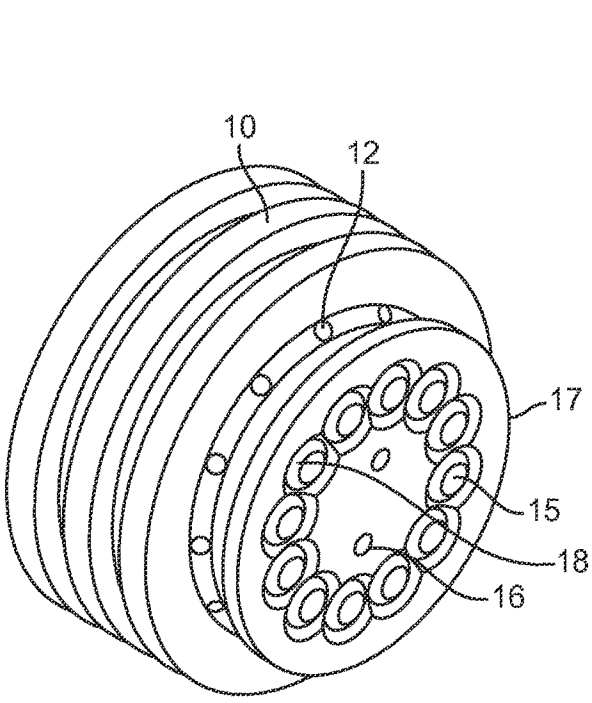
FIG. 4 illustrates a perspective view of the diffuser assembly of FIG. 2.
Figure 3:
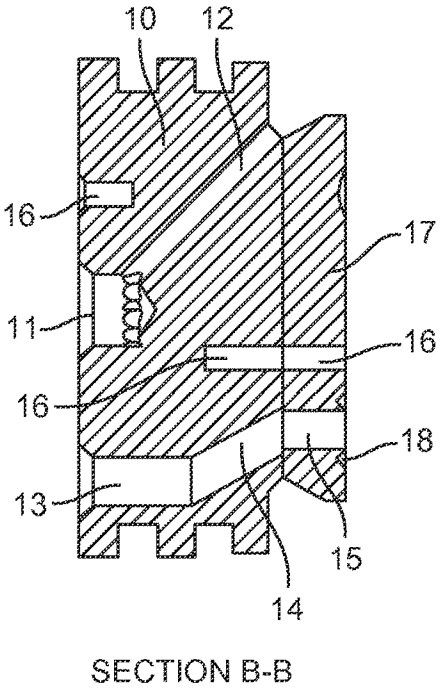
FIG. 3 illustrates a cross-sectional view of the diffuser assembly of FIG. 2 along section line B-B of FIG. 2.
Figure 2:
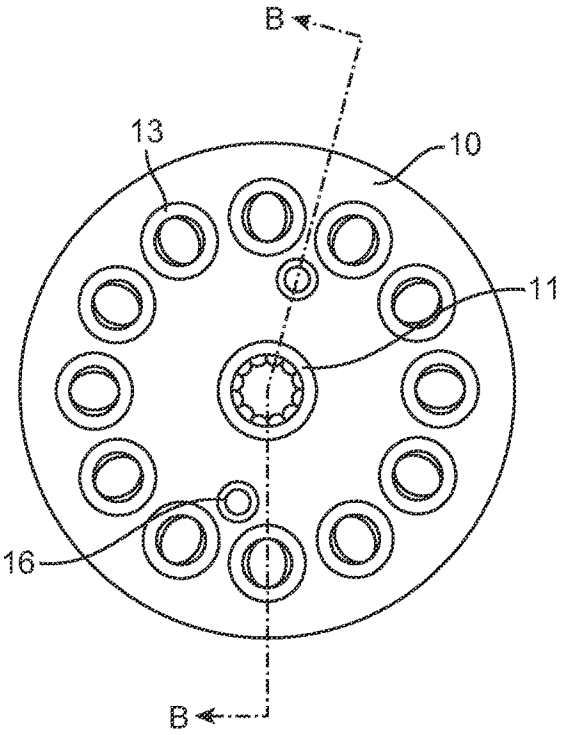
FIG. 2 illustrates an overhead view of a diffuser assembly of a beverage dispensing system, in accordance with many embodiments.

As can be seen in the exemplary embodiment of FIGS. 2-4, the device includes a diffuser assembly for use with a dispensing nozzle in a multiple beverage dispensing system. FIG. 2 shows an overhead view of the dispensing array 10 where the center inlet 11 of the beverage base and the inlets 13 of each of the beverage additive channels are clearly visible. Similar to a conventional dispensing array, the beverage base, such as water or a soda component, enters the center top inlet 11 of the dispensing array 10 and is diverted radially outward along multiple paths 12 of smaller diameter (as shown in FIG. 3) and discharged through a series of exit holes arranged in a ring near the bottom of the dispensing array 10 (as shown in FIG. 4). The inlet portions 13 of the multiple paths for beverage additives may be arrange in a radial array near an outside circumference of the dispensing array (as seen in FIG. 2), also similar to that of a conventional dispensing array, to facilitate a proper connection with the dispensing means of the beverage additives and base into the dispensing array 10. In many embodiments, the multiple paths for beverage additives also include an angled portion 14 at a point of depth that diverts flow of additive inward for a particular distance and angle, the additive paths 14 remaining separate from the beverage base paths 12. Typically, the distance along which the flow path extends along the angled portion 14 is longer than the distance along which the flow path extends along the outlet portion 15.

In many embodiments, the device includes one or more alignment and/or attachment features 16 configured to engage with corresponding alignment and/or attachment features so as to facilitate proper assembly and attachment of the dispensing array and any associate components into a beverage dispensing system. Corresponding alignment or attachment features 16 may include a hole that receivably engages a corresponding locating pin of the dispensing system or any suitable means for assembling the device.

In contrast to conventional devices, the exemplary device of FIGS. 2-4 includes a dispense point isolation device 17. As can be seen in FIG. 3, the dispense point isolation device 17 includes beverage additive flow channels 15 that direct the flow of beverage additive in a substantially vertical direction. The beverage base is discharged from ports exiting the base paths 12 distributed around the outside circumference of the dispense point isolation device 17 (as shown in FIG. 4), although alternative configurations could be used. As configured, the flow channels 15 divert the downward flow of a beverage additive at the point at which many conventional devices discharge the additive from the array at a diagonal angle. By directing the flow path in a substantially vertical direction, the dispense point isolation device 17 allows the outlet orifices to extend along a substantially horizontal plane on the bottom surface. This feature is advantageous as it inhibits dripping of at-rest fluids and allows the exit orifices to be more circular than orifices disposed on an angled surface of a conical cavity, as in many conventional designs.

In many embodiments, the diameter of each of these vertical flow paths 15 is by design smaller than the preceding path from which the additive flows into the vertical flow path 15 (as can be seen in FIG. 3). The reduced diameter of the flow path 15 at the outlet point as well as its vertical orientation provide for improved discharge of the beverage additive with minimal dripping or residue that often results due to a fluid's surface tension and capillary resistance properties. This is advantageous since any dripping or residue may cause the additive to remain at or within the path while at-rest resulting in contamination of subsequent beverages. The substantially vertical flow paths 15 are further advantageous in that directing the flow paths 15 downward increase the separation or distance between the exit orifices as compared to a conventional array having exit outlets on an angled surface of a conical cavity.

In many embodiments, the dispense point isolation device 17 includes an additional isolating feature 18 to further isolate the flow of additive from each flow path 15 so as to inhibit commingling of colored and/or non-colored beverage additives or cross-contamination between beverages. As shown in FIG. 4, the isolating feature 18 may be a recess, notch, trough or well around the exit orifice of each flow path 15, typically surrounding or circumscribing the exit orifice. Such a feature may be formed by use of a countersink or bore at each exit orifice or any other suitable means. In this embodiment, the isolating feature 18 acts to prevent the transfer of additive to an adjacent orifice. Typically, any residual additive remains within the well by means of surface tension thereby preventing travel of any residual additive to an adjacent orifice.

In another aspect, the beverage base paths 12 are each configured to have a diameter less than that of the central inlet 11. In many embodiments, the dispensing array 10 is configured so that the combined cross-sectional areas of the multiple beverage base paths 12 are less than the cross-sectional area of the center inlet 11 at the top of the dispensing array 10. This configuration allows for improved retention of carbonation of a carbonated beverage base when dispensed through the array 10.

Figure 6:
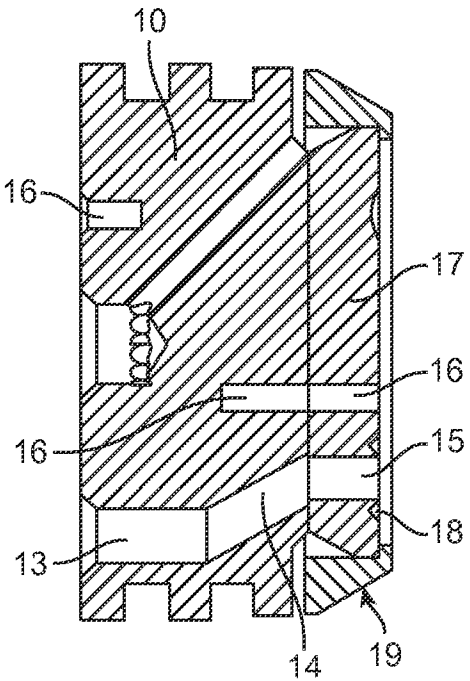
FIG. 6 illustrates a cross-sectional view of the diffuser assembly of FIG. 5 along section line C-C.
Figure 5:
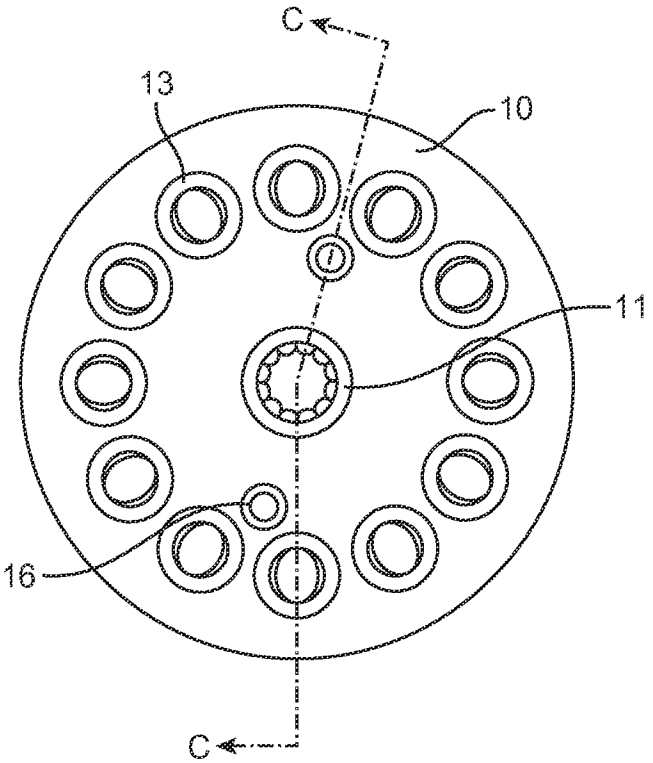
FIG. 5 illustrates an overhead view of a diffuser assembly of a beverage dispensing system with a removable diffuser ring, in accordance with many embodiments.
Figure 8:
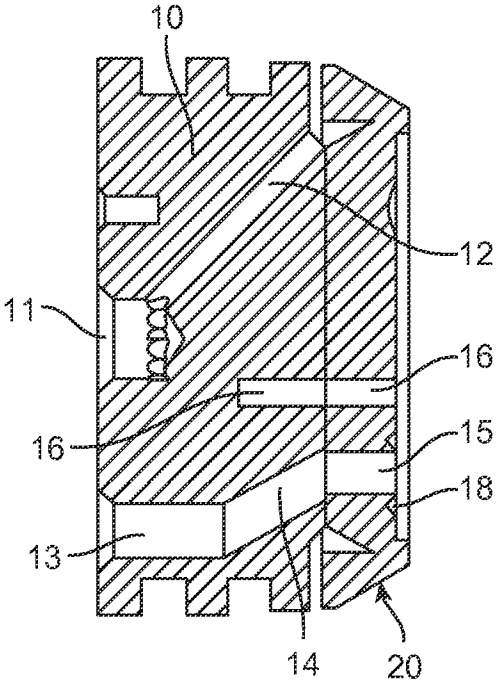
FIG. 8 illustrates a cross-sectional view of the diffuser assembly of FIG. 7 along section line D-D.
Figure 7:
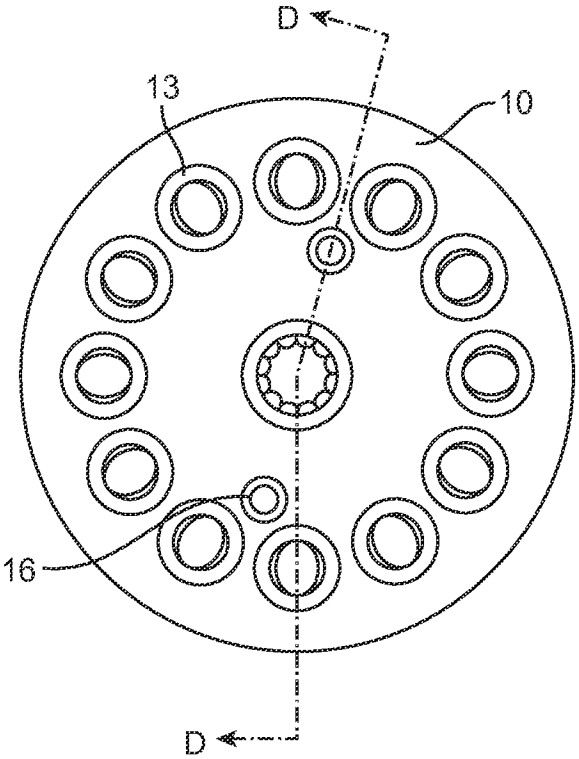
FIG. 7 illustrates an overhead view of a diffuser assembly of a beverage dispensing system with an integrated, non-removable diffuser ring, in accordance with many embodiments.
Figure 9:
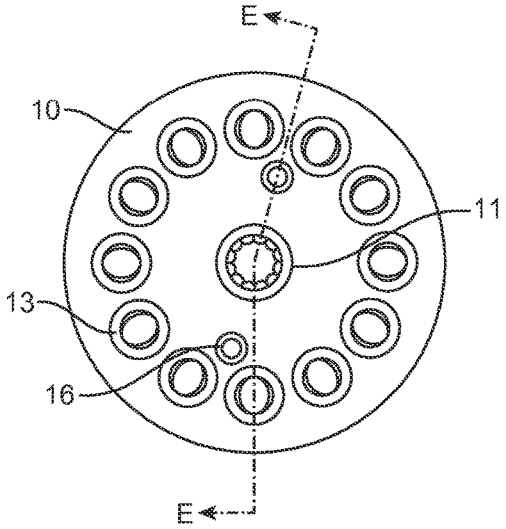
FIG. 9 illustrates an overhead view of a diffuser assembly of a multiple beverage dispensing system having an integrated diffuser ring and a circular levee or tubular projections disposed around each exit orifice, in accordance with an embodiment.

In the exemplary embodiment of FIGS. 5 and 6, the device includes an additional diffusing ring 19 and/or other similar components, which may be incorporated into the device or may be removable as needed for dispensing of a particular beverage. For example, the additional diffusing ring 19 may be an enhancing juice diffuser ring to facilitate dispensing of fruit juices. Typically, the ring diverts the flow of the beverage base through the additional diffusing ring 10 as desired for a given beverage base. Additionally, the ring may include a protruding lip that extends a distance away from and substantially circumscribes the bottom surface of the dispensing array 10 to further isolate the array of exit orifices on the bottom surface. In the embodiment shown FIG. 7 and FIG. 8, which illustrate an overhead view and cross-sectional view along section line D-D, respectively, the dispensing array 10 includes a dispense point isolation device 20 having an integrated diffusing ring.

In the exemplary embodiment of FIGS. 9-12, which illustrate an overhead view, a cross-sectional view along section line E-E, a side view and a perspective view, respectively, the dispense point isolation device 20 includes an integrated diffuser ring and an isolating feature 18 comprising a tubular projection extending a distance away from the flat bottom surface of the diffuser assembly so as to further isolate the additive flowing from the exit orifice of the additive channel 15. In other embodiments, the isolating features may include any of levee, a wall, or raised ridge substantially surrounding one or more exit orifices. In many embodiments, an isolating feature 18 comprising a levee or wall is formed integrally during molding of the dispense point isolation device 17, while in other embodiments, such isolating features 18 can be formed separately and attached to the dispense point isolation device 17. In some embodiments, the isolation feature 18 may include any or all of a well, recess, trough, raised ridge, levee, wall, and tubular projection or any combination thereof.

Figure 11:
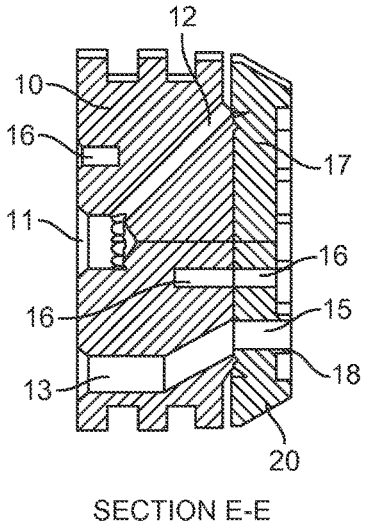
FIG. 11 illustrates a cross-section view of the diffuser assembly of FIG. 9.
Figure 10:
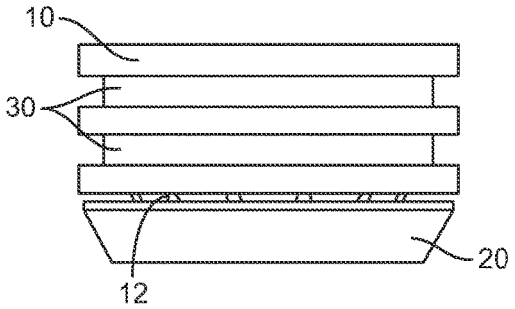
FIG. 10 illustrates a side view of the diffuser assembly of FIG. 9.
Figure 12:
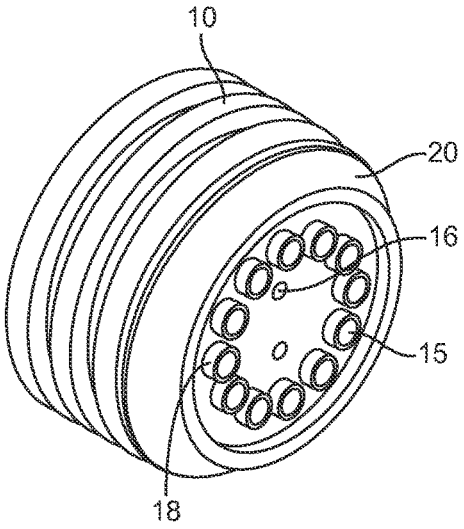
FIG. 12 illustrates a perspective view of the diffuser assembly of FIG. 9.

As can be seen in FIGS. 10-12, the assembly includes two O-rings 30 for frictional assembly and sealing of a dispensing nozzle onto the diffuser assembly. The O-rings 30 may include an elastic or deformable material, such as a silicone, rubber, or polymer, to enhance sealing when the assembly is inserted into a beverage dispenser. Although two O-rings are shown in this embodiment, it is appreciated that one or more O-rings may be used, as well as various other interfacing or sealing features.

Another embodiment is depicted in FIGS. 13-16, which illustrate an overhead view, a cross-sectional view along section line F-F, a side view and a perspective view of a dispense point isolation device 20 and dispensing array 10, respectively. Similar features corresponding to those identified in FIGS. 9-12 are shown.

As can be seen in FIGS. 13-16, the diffuser assembly includes a single O-ring 30 for frictional assembly and sealing of a dispensing nozzle onto the diffuser assembly in addition to one or more twist-lock features 21 engageable with a corresponding twist-lock feature in a dispensing nozzle. The twist-lock feature is configured so that assembly of the dispensing nozzle over the diffuser assembly and rotation of the dispensing nozzle relative to the diffuser assembly engages the twist-lock features 21 of the dispensing nozzle with corresponding features of the diffuser assembly so as to sealingly attach the dispensing nozzle onto the diffuser assembly. The O-ring 30 enhances the seal, while the twist-lock features 21 provide a locking force to secure the dispensing nozzle upon the diffuser assembly.

Figure 13:
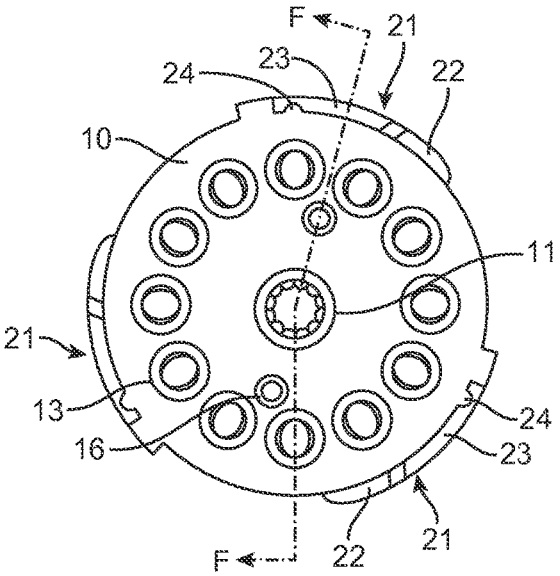
FIG. 13 illustrates an overhead view of a diffuser assembly of a multiple beverage dispensing system having an integrated diffuser ring and a circular levee or tubular projections disposed around each exit orifice, in accordance with an alternative embodiment.
Figure 15:
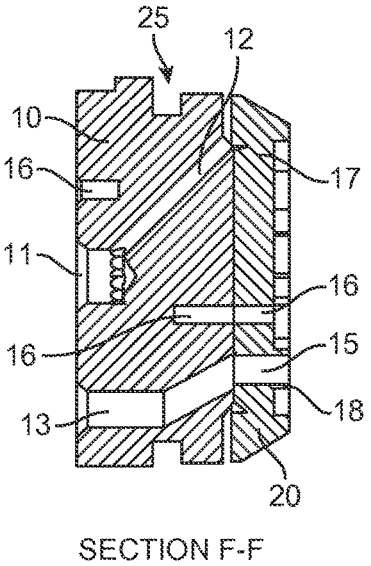
FIG. 15 illustrates a cross-sectional view of the diffuser assembly of FIG. 13.
Figure 14:
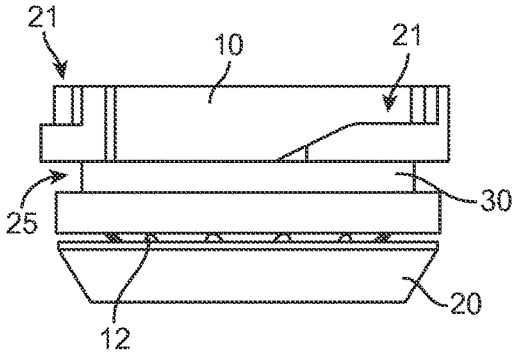
FIG. 14 illustrates a side view of the diffuser assembly of FIG. 13.
Figure 16:
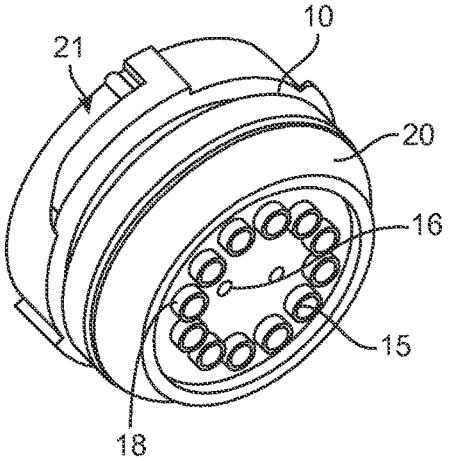
FIG. 16 illustrates a perspective view of the diffuser assembly of FIG. 13.

As shown in FIGS. 13 and 14, the diffuser assembly includes three twist-lock features 21 spaced around the circumference of the assembly to provide a uniform distribution of locking and sealing forces, although more or fewer than three twist-lock features may be used in various embodiments. Each of the twist-lock features may include a ramped surface 22, a level surface 23 and a locking feature 24 above a recessed portion 25 that extends, at least partly, around the circumference of the diffuser assembly below the twist-lock feature. The locking portion 24 may include a feature, such as a bump or protrusion, that resiliently engages with a corresponding locking feature of the beverage dispenser, such as recess. The twist lock features 21 extend outward from the circumference but typically do not extend entirely around the circumference so as to allow a supporting feature of the dispensing nozzle to be positioned about the circumferential recess 25 and extend under the twist-lock features 21 when the assembly is rotated so as to support the dispensing nozzle when the locking features are engaged.

Although the positions of the inlet portions of each of the beverage additive channels and the beverage base channels in the top surface of the dispensing array 10 appear similar to that of conventional devices, it is appreciated that the inlet portions may vary according to any number of differing configurations. The above described configuration of the top surface may be advantageous, in many respects, however, as it allows the device to be used to replace a conventional dispensing array in an existing beverage dispensing system.

In many embodiments, the dispense point isolation device is configured to complement the dispensing array or diffuser of a beverage dispenser, in some cases even conventional dispenser systems. For example, in some embodiments, the device may include a dispense point isolation device configured to couple with a conventional dispensing array, so that a user can improve an existing dispensing system through incorporation of a device in accordance with the present invention. For example, an upper surface of a dispensing point isolation device may include a conical protrusion so as to engage and fluidly couple with a conventional dispensing array and still provide any or all of the improvements associated with the embodiment described herein. Although in many embodiments, the dispense point isolation device is a separate component, it is appreciated that the features of the dispense point isolation may be integrated with and/or incorporated into the diffuser assembly in a variety of ways, in accordance with the principles of the present invention.

The above description is illustrative and is not restrictive. A recitation of "a", "an" or "the" is intended to mean "one or more" unless specifically indicated to the contrary. Many variations of the disclosure will become apparent to those skilled in the art upon review of the disclosure. One or more features from any embodiment described herein may be combined with one or more features of any other embodiment without departing from the scope of the disclosure. The scope of the disclosure should, therefore, be determined not with reference to the above description, but instead should be determined with reference to the pending claims along with their full scope or equivalents.

What is claimed is:

1. A beverage dispensing device comprising:

a dispensing nozzle for separately dispensing a plurality of differing beverages, each beverage comprising a beverage base and at least one beverage additive, wherein the dispensing nozzle is configured to be supported within an upright standing beverage dispensing system;

a dispensing array having a top surface, an underside surface and a plurality of fluid flow paths and channels extending therebetween, wherein the fluid flow paths facilitate downward flow of one or more beverage bases and the plurality of channels facilitate downward flow of one or more beverage additives, wherein the dispensing array is configured for removable coupling with the dispensing nozzle; and a dispense point isolation device attached to an underside of the dispensing array, the dispense point isolation device having a plurality of additive outlet paths, each additive outlet path extending from an upper surface of the dispense point isolation device to respective exit orifice in a bottom surface of the dispense isolation device, wherein the upper surface of the dispense point isolation device is coupled to the underside of the dispensing array so as to fluidly couple each of the plurality of outlet paths with a corresponding channel of the dispensing array such that a respective additive of the one or more additives contacts an interior surface of a corresponding flow path of the plurality when flowing therethrough and exits directly from the respective exit orifice, wherein during operation of the dispensing device, the outlet portion extends a distance substantially vertical adjacent the exit orifice so as to direct a flow of an additive from the exit orifice in a substantially vertical direction for mixing with the beverage base within the dispensing nozzle so as to promote uniform discharge of the additive through the exit orifice and inhibit travel of any residual additive to an adjacent exit orifice.

2. The beverage dispensing device of claim 1, wherein the exit orifices extends along a substantially horizontal plane so as to promote uniform discharge of the additive through the exit orifice.

3. The beverage dispensing device of claim 2, wherein each of the dispensing array and the dispense point isolation device are substantially circular and concentric about a central longitudinal axis extending therethrough.

4. The beverage dispensing device of claim 3, wherein the plurality of exit orifices are arranged in a radial array about the central longitudinal axis.

5. The beverage dispensing device of claim 4, wherein the top surface of the dispensing array includes a plurality of entry orifices, each orifice corresponding to a channel of the plurality, wherein the entry orifices are arranged in a radial array about the central longitudinal axis.

6. The beverage dispensing device of claim 5, wherein each of the channels includes an angled portion extending a distance inward toward the central longitudinal axis along the downward flow path.

7. The beverage dispensing device of claim 5, wherein each of the channels includes a substantially vertical entry portion adjacent the corresponding entry orifice of the respective channel.

8. The beverage dispensing device of claim 1, wherein a diameter of the outlet path is less than a diameter of the channel of the dispensing array upstream of the outlet path.

9. The beverage dispensing device of claim 1, wherein the dispense point isolation device comprises a substantially flat bottom surface extending along a substantially horizontal plane, wherein the plurality of channels terminate in the exit orifices within the bottom surface.

10. The beverage dispensing device of claim 1, wherein the bottom surface comprises an isolation feature adjacent each exit orifice so as to further inhibit travel of any residual additive dispensed from the respective exit orifice to an adjacent exit orifice.

11. The beverage dispensing device of claim 10, wherein the isolation feature comprises a recess or countersink in the bottom surface substantially surrounding a respective exit orifice.

12. The beverage dispensing device of claim 10, wherein the isolation feature comprises a trough or notch in the bottom surface substantially surrounding a respective exit orifice.

13. The beverage dispensing device of claim 10, wherein the isolation feature comprises a raised ridge in the bottom surface substantially surrounding a respective exit orifice.

14. The beverage dispensing device of claim 10, wherein the isolation feature comprises a levee or wall extending a distance away from the bottom surface surrounding a respective exit orifice.

15. The beverage dispensing device of claim 10, wherein the isolation feature comprises a tubular projection extending a distance away from the bottom surface surrounding a respective exit orifice.

16. The beverage dispensing device of claim 10, wherein the isolation feature comprises any or all of a recess, notch, trough, raised, ridge, wall, levee or tubular projection, substantially, or any combination thereof.

17. The beverage dispensing device of claim 1, wherein the fluid flow paths for beverage base direct fluid flow of beverage base around the dispense point isolation device into the dispensing nozzle for mixing with the additive discharged through the dispense point isolation device.

18. The beverage dispensing device of claim 1, wherein the dispensing array includes a central inlet in the top surface for supplying the plurality of flow paths with a flow of beverage base, wherein a diameter of one or more of the plurality of flow paths is less than a diameter of the central inlet.

19. The beverage dispensing device of claim 18, wherein a cross-sectional areas of each of the plurality of flow paths, in combination, is less than a cross-sectional area of the inlet portion.

20. The beverage dispensing device of claim 1, wherein one or both of the dispensing array and the dispense point isolation device comprise one or more alignment and/or attachment features engageable with one or more corresponding alignment and/or attachment feature of at least one of the dispensing array, the dispense point isolation device and a housing of the beverage dispensing device to facilitate assembly of the beverage dispensing device.

21. The beverage dispensing device of claim 1, wherein the dispensing array includes one or more sealing features and a locking feature to secure the dispensing array with the dispensing nozzle, wherein the one or more sealing features and the locking feature are configured so as to replace a conventional dispensing array within a conventional dispensing nozzle.

22. The beverage dispensing device of claim 21, wherein the sealing features comprise one or more O-rings, the O-rings comprising an elastic or deformable material to facilitate sealing between the dispensing array and the dispensing nozzle.

23. The beverage dispensing device of claim 21, wherein the locking feature comprises a plurality of twist-lock features distributed about the dispensing array, each of the plurality of twist-lock features having a ramped guide surface and a locking feature, the ramped guide surface and locking feature being engageable with one or more corresponding surfaces of the dispensing nozzle such that assembly of the dispensing array with the dispensing nozzle engages the ramp guide surface with a corresponding surface of the dispensing nozzle and rotation of the dispensing nozzle relative to the dispensing array engages the locking feature to a corresponding surface thereby securing the dispensing array with the dispensing nozzle.

24. The beverage dispensing device of claim 1, wherein the dispensing array is an integral component with the plurality of fluid flow paths and channels defined therein.

25. The beverage dispensing device of claim 1, wherein the beverage dispensing array and the dispense point isolation device are configured such that the beverage base is directed around the dispense isolation device without passing through the plurality of additive outlet paths of the dispense point isolation device.

26. A beverage dispensing device comprising:

a dispensing nozzle for separately dispensing a plurality of differing beverages, each beverage comprising a beverage base and at least one beverage additive;

a removable dispensing array having a top surface, an underside surface and a plurality of fluid flow paths and channels extending therebetween, wherein the fluid flow paths facilitate downward flow of one or more beverage bases and the plurality of channels facilitate downward flow of one or more beverage additives;

a dispense point isolation device attached to an underside of the dispensing array, the dispense point isolation device having a plurality of additive outlet paths, each additive outlet path extending from an upper surface of the dispense point isolation device to respective exit orifice in a bottom surface of the dispense isolation device, wherein the upper surface of the dispense point isolation device is coupled to the underside of the dispensing array so as to fluidly couple each of the plurality of outlet paths with a corresponding channel of the dispensing array such that a respective additive of the one or more additives contacts an interior surface of a corresponding flow path of the plurality when flowing therethrough and exits directly from the respective exit orifice, wherein during operation of the dispensing device, the outlet portion extends a distance substantially vertical adjacent the exit orifice so as to direct a flow of an additive from the exit orifice in a substantially vertical direction for mixing with the beverage base within the dispensing nozzle so as to promote uniform discharge of the additive through the exit orifice and inhibit travel of any residual additive to an adjacent exit orifice; and a diffusing ring substantially circumscribing the bottom surface of the dispense point isolation device for diverting a flow of beverage base discharged from the fluid flow paths.

27. The beverage dispensing device of claim 26, wherein the diffusing ring is configured to enhance a beverage base flowing therethrough.

28. The beverage dispensing device of claim 26, wherein the diffusing ring is releasably attachable to the bottom surface.

29. The beverage dispensing device of claim 26, wherein the diffusing ring is integral with the dispense point isolation device.

30. A removable dispensing array assembly for use with a multi-beverage dispensing nozzle of an upright standing beverage dispensing system, the assembly comprising:

a dispensing array having a top surface, an underside surface and a plurality of fluid flow paths and channels extending therebetween, wherein the fluid flow paths facilitate downward flow of one or more beverage bases and the plurality of channels facilitate downward flow of one or more beverage additives;

a dispense point isolation device attached to an underside of the dispensing array, the dispense point isolation device having a plurality of additive outlet paths, each extending from an upper surface to an exit orifice in a bottom surface of the dispense isolation device, wherein the upper surface of the dispense point isolation device is coupled to the underside of the dispensing array so as to fluidly couple each of the plurality of outlet paths with a corresponding channel of the dispensing array, wherein the dispense point isolation device is configured such that each outlet path includes an outlet portion that extends a distance substantially vertical adjacent the exit orifice so as to direct a flow of an additive from the exit orifice in a substantially vertical direction to more uniformly distribute discharge of the additives from the exit orifice, wherein the dispense point isolation device is further configured so that the one or more beverage additives directly contact an inside surface of a corresponding additive flow path of the plurality when dispensed therethrough, wherein the dispense point isolation device further includes an isolation feature surrounding each exit orifice, the isolation feature comprising any or all of a recess, a notch, a wall or tubular protrusion, so as to prevent retention of any residual beverage additive along the respective exit orifice and to prevent travel of additive along the underside surface to an adjacent exit orifice when the one or more beverage additives are dispensed through a corresponding additive flow path of the plurality so as to inhibit cross-contamination and color carryover of beverage additives.

31. The dispensing array assembly of claim 30, wherein dispensing array assembly includes one or more sealing features and a locking feature configured so as to be compatible with a conventional multi-beverage dispensing nozzle so as to replace a conventional dispensing array to inhibit cross contamination and color carryover of beverage additives as compared to dispensing multiple beverages with the conventional nozzle having the conventional dispensing array.

* * * * *